United States Patent [19]

Petterson et al.

[11] Patent Number: 4,479,869

[45] Date of Patent: Oct. 30, 1984

[54] FLEXIBLE FEED PYROLYSIS PROCESS

[75] Inventors: William C. Petterson, Missouri City; Larry G. Hackemesser, Houston, both of Tex.

[73] Assignee: The M. W. Kellogg Company, Houston, Tex.

[21] Appl. No.: 561,408

[22] Filed: Dec. 14, 1983

[51] Int. Cl.[3] ..... C10G 9/36; C10G 9/14; C07C 4/04

[52] U.S. Cl. ..... 208/130; 208/132; 585/652; 585/648

[58] Field of Search ..... 208/130, 132, 48; 585/652, 648

[56] References Cited

U.S. PATENT DOCUMENTS

| | | | |
|---|---|---|---|
| 2,111,899 | 3/1938 | Nagel | 260/170 |
| 2,111,900 | 3/1938 | Nagel | 260/170 |
| 2,176,962 | 10/1939 | Grebe | 260/683 |
| 2,945,076 | 7/1960 | Pardee | 260/683 |
| 3,124,424 | 3/1964 | Hartley et al. | 208/130 |
| 3,718,709 | 2/1973 | Simonetta | 208/130 |
| 4,107,226 | 8/1978 | Ennis, Jr. et al. | 208/130 |
| 4,321,131 | 3/1982 | Lowe | 585/648 |
| 4,324,649 | 4/1982 | Parizot et al. | 208/130 |
| 4,361,478 | 11/1982 | Gengler et al. | 208/130 |

FOREIGN PATENT DOCUMENTS

| | | | |
|---|---|---|---|
| 633892 | 1/1978 | U.S.S.R. | 585/652 |

*Primary Examiner*—Delbert E. Gantz
*Assistant Examiner*—Chung K. Pak

[57] ABSTRACT

Hydrocarbon feed to a steam cracking furnace is heated to near cracking temperature by indirect heat exchange with steam to permit use of a range of feedstocks.

5 Claims, 2 Drawing Figures

| VALVE | 19 | 20 | 21 | 22 | 23 | 24 | 25 | 26 | 27 |
|---|---|---|---|---|---|---|---|---|---|
| ETHANE PROPANE | O | C | C | O | C | O | C | C | O |
| NAPHTHA | C | O | O | O | O | C | C | O | C |
| VACUUM GAS OIL | C | O | C | C | O | C | O | O | C |

FLEXIBLE FEED PYROLYSIS PROCESS

This invention relates to steam pyrolysis of hydrocarbons in tubular, fired furnaces to produce cracked gases containing ethylene.

The basic components of steam cracking or steam pyrolysis furnaces have been unchanged for many years. The furnaces comprise a radiant box fired to high temperature with oil or gas and a cracking coil disposed within the box. Coil outlet temperatures are between about 815° C. and 930° C. The furnaces additionally comprise a convection coil section for utilization of waste heat in preheating hydrocarbon feed, heating diluent steam, heating the mixed feed of diluent steam and hydrocarbon feed, and utility fluid heating for use in the ethylene unit.

While fundamental elements of these furnaces are the same, specific radiant section designs vary according to requirements of product mix, feedstock choice, heat efficiency, and cost. Nevertheless, radiant sections can be designed to handle a wide spectrum of feedstocks and product mixes by varying the dilution steam ratio and furnace firing.

Regrettably, this flexibility does not exist in the convection section because of the wide variation in steam and hydrocarbon feed preheat duties that exist for ethane at one end of the feed spectrum to vacuum gas oil at the other end. By way of example, up to nine times as much dilution steam may be required for gas oil cracking than for ethane cracking which, in turn, requires substantially larger coil surface. By way of further example, cracking conversion to ethylene from gas oil is substantially lower than that from ethane. For constant ethylene production, therefore, more gas oil must be preheated and, additionally, vaporized. This increased heat duty, again, requires substantially larger coil surface. There are other examples but it is sufficient to state that a cracking furnace designed for gas feedstock cannot be effectively used with a liquid feedstock and vice versa. To a lesser extent, this inflexibility also exists between naphtha and gas oil feedstocks.

Aside from the problem of inflexibility, it should be noted that gas oil feedstocks are notoriously sensitive to preheating because their incipient cracking temperature range is broader and lower than that of lighter feedstocks. In view of the large heat duty requirement for gas oil preheating, relatively hot combustion gas in the convection section is necessarily employed for the heat source. This combination of factors often leads to undesired cracking in the feed preheat coil. Long residence time of feedstock in this coil regrettably results in some coke laydown from degeneration of the cracking products.

It is, therefore, an object of this invention to provide a steam cracking process having flexibility to process a range of feedstocks. It is a further object to provide a steam cracking process which reduces the propensity for coke laydown when preheating liquid hydrocarbon feedstocks.

According to the invention, a process is provided for steam cracking hydrocarbon feed in a tubular, fired furnace having a radiant section and a convection section wherein the hydrocarbon feed is heated within the temperature range from abut 370° C. to about 700° C. by indirect heat exchange with superheated steam.

In a preferred embodiment of the invention, the steam employed is superheated in the convection section of the steam cracking furnace. In a most preferred embodiment, mixed feed of dilution steam and hydrocarbon feed is heated by indirect heat exchange with steam that has been superheated in the convection section. When the hydrocarbon feed is a gas feed selected from the group consisting of ethane, propane, and mixtures thereof, the mixed feed is heated to a temperature within the range from about 600° C. to about 700° C. When the hydrocarbon feed is naphtha having an endpoint between about 150° C. and about 250° C., the mixed feed is heated to a temperature within the range from about 430° C. to about 650° C. When the hydrocarbon feed is gas oil having an endpoint between about 290° C. and about 570° C., the mixed feed is heated to a temperature within the range from about 450° C. to about 570° C.

Figure 1:
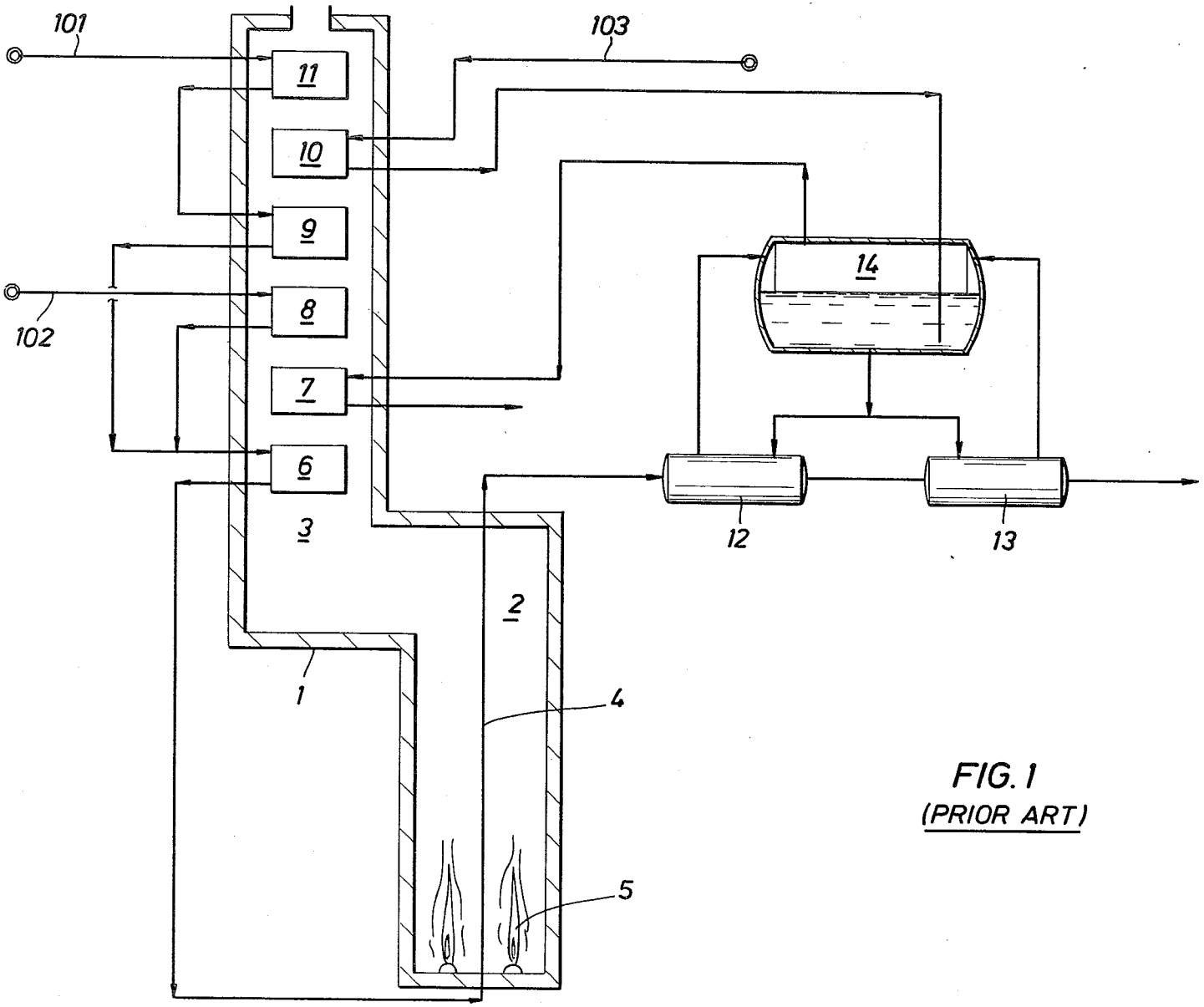
FIG. 1 (PRIOR ART)
FIG. 1 illustrates a typical prior art flow scheme for steam cracking ethane in which dilution steam and hydrocarbon feed preheating duties are furnished by indirect heat exchange with combustion gas in the convection section of the cracking furnace.

Referring first to the prior art configuration of FIG. 1, there is shown a pyrolysis unit comprised of a tubular fired furnace having a radiant section 2 and convection section 3. Vertical cracking tubes 4 disposed within the radiant section are heated by floor burners 5. Hot combustion gas from the radiant section at a crossover temperature of about 1150° C. passes upwardly through the convection section 3 where heat is successively absorbed from the combustion gas by convection coils 6, 7, 8, 9, 10, and 11. The pyrolysis unit additionally comprises primary quench exchanger 12, secondary quench exchanger 13, and steam drum 14. The quench exchangers rapidly cool the cracked gases to stop pyrolysis side reactions and recover heat in the form of high pressure steam.

In operation on ethane/propane feedstock, process steam recovered from the downstream product separations unit is utilized as dilution steam for the steam cracking process and introduced via line 101 to coils 11 and 9 where it is heated to about 400° C. The ethane/propane mixture is introduced via line 102 to coil 8 where it is preheated to about 430° C. and then combined with hot dilution steam. The resulting mixed feed of dilution steam and hydrocarbon feed is then introduced to coil 6 where it is heated to about 650° C. which is near the incipient cracking temperature for this feedstock. The mixed feed is then introduced to cracking tubes 4 in the furnace radiant section and the resulting cracked gas is quenched and cooled in quench exchangers 12 and 13.

Since available heat in the convection section is more than sufficient for feed preheating, low level heat is recovered by preheating boiler feed water introduced through line 103 to coil 10. Correspondingly, high level heat is recovered from a lower portion of the convection section by superheating 315° C. saturated steam from drum 14 in coil 7. The resulting superheated, high pressure steam is employed in turbine drives in the downstream separations section.

The convection coil arrangement of FIG. 1 designed for ethane/propane feed preheating duties is not satisfactory for equivalent ethylene production from heavier feeds such as naphtha or gas oil. Gas oil, for example, is normally liquid and must be fed in substantially greater quantity than ethane/propane to obtain equivalent ethylene production. Accordingly, coil 8 is too small for complete vaporization of gas oil and liquid carryover to coil 6 will result in coke laydown there. Further, gas oil cracking requires up to nine times the quantity of dilution steam required for ethane/propane cracking. As a result, coils 6, 8, and 9 are undersized for heavy feeds.

Figure 2:
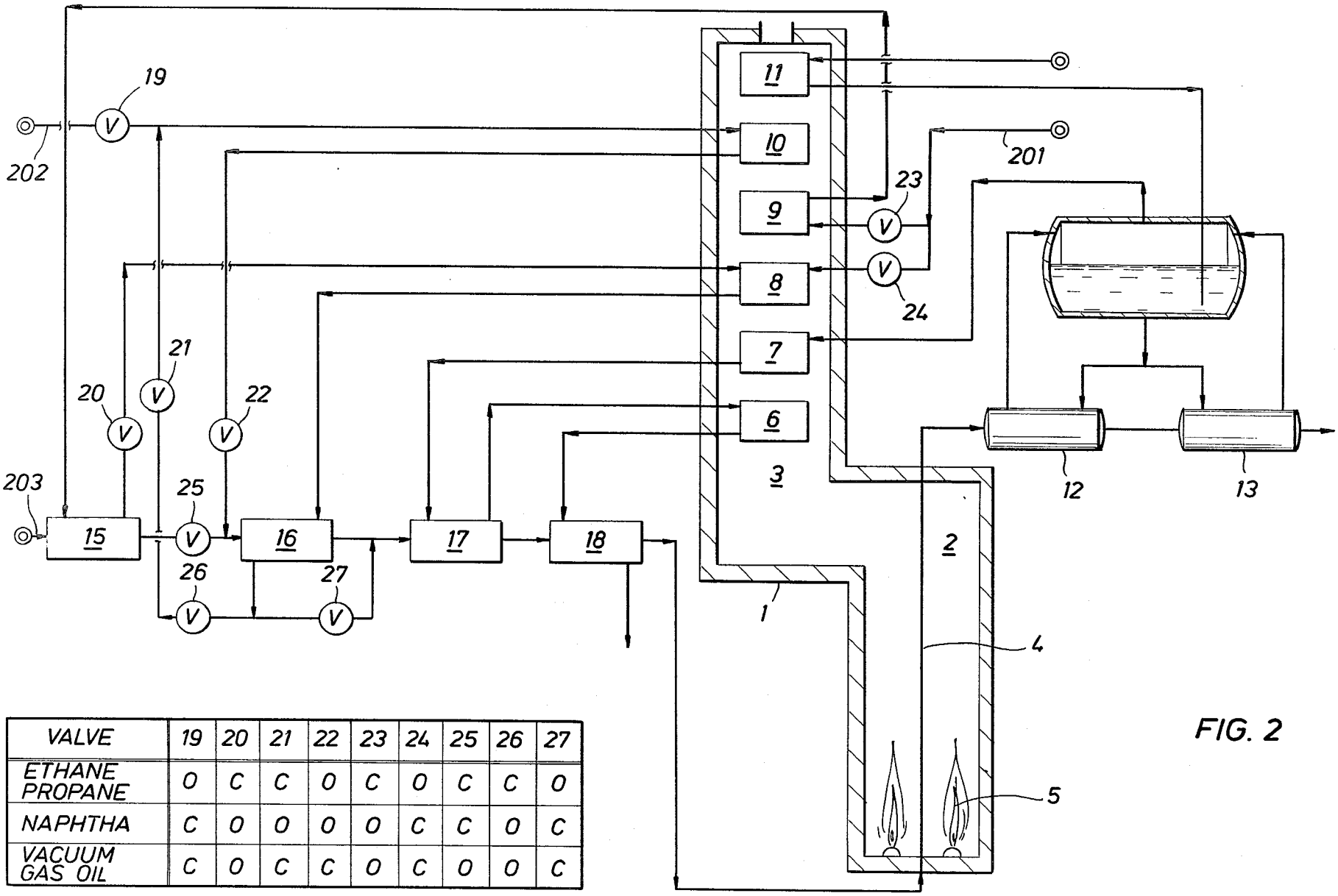
FIG. 2 is a flow scheme for steam cracking hydrocarbons by an embodiment of the present invention wherein feed preheating duty and, optionally, other heat duties are furnished by indirect heat exchange with superheated steam.

Referring now to FIG. 2, an embodiment of the present invention, the reference numerals in common with FIG. 1 have the same identification and general function except that convection coils 6 and 8 are now in steam service in contrast to FIG. 1 where they were in hydrocarbon heating service.

FIG. 2 additionally shows shell and tube heat exchangers 15, 16, 17, and 18, external to the furnace, which are employed for heating hydrocarbon feedstock to near cracking temperatures. The figure also shows valves 19 through 27 which, depending on the particular feedstock characteristics, direct feedstock to specific sequences of heat exchange according to the required heating duties.

In operation of the process of the invention as embodied in FIG. 2 using ethane/propane feedstock, valves 19 through 27 are positioned as indicated in the legend on FIG. 2. Dilution steam is introduced via line 201 to coil 8 where it is heated to about 580° C. and then passed to heat exchanger 16 where it gives up heat in preheating hydrocarbon feed introduced via line 202 and coil 10. The feed entering heat exchanger 16 is at a temperature of about 245° C. Dilution steam and hydrocarbon feed are combined between heat exchangers 16 and 17 and the resulting mixed feed is further heated to about 650° C. in heat exchangers 17 and 18 by indirect heat exchange with steam that has been superheated respectively in coils 7 and 6 in the convection section of the cracking furnace. The high pressure steam discharged from heat exchanger 18 still retains sufficient superheat for operation of turbine drives in the separations section of the olefins plant. In the ethane/propane operation described, heat exchanger 15 and coil 19 in the furnace convection bank are not in use. A small amount of steam may be passed through coil 9 to prevent excessive metal temperatures if necessary.

When operating the process system of FIG. 2 using vacuum gas oil feedstock, valves 19 through 27 are repositioned as indicated in the legend on FIG. 2. Dilution steam introduced through line 201 now passes through coil 9 where it is heated to only about 455° C. and then passed to heat exchanger 15 where it gives up heat in preheating hydrocarbon feed introduced via line 203. The dilution steam is reheated in coil 8 and passed through heat exchanger 16 where it gives up heat to the mixed feed resulting from the combination of hydrocarbon feed leaving heat exchanger 15 and dilution steam leaving heat exchanger 16. Mixed feed is further heated to about 540° C. in heat exchangers 17 and 18 in the manner previously described except that operating temperatures in these heat exchangers and convection coils 6 and 7 are somewhat lower. A particularly unique feature of the present invention is that gas oil feed remains substantially unchanged in chemical composition as it passes through the external heat exchangers because of the close temperature control permitted by indirect heat exchange with steam.

Operation of the process system of FIG. 2 on naphtha is not described here other than to note that the naphtha is also introduced via line 203. This operation is readily apparent by reference to the valve legend on FIG. 2.

We claim:

1. In a process for steam cracking hydrocarbon feed in a tubular, fired furnace having a radiant section and a convection section wherein dilution steam is added to the hydrocarbon feed and the resulting mixed feed of dilution steam and hydrocarbon feed is heated to near incipient cracking temperature prior to introduction of the mixed feed to the radiant section, the improvement which comprises heating the hydrocarbon feed within the temperature range from about 370° C. to about 700° C. by indirect heat exchange with superheated steam and at least a portion of the superheated steam is generated in the convection section of said tubular, fired furnace.

2. The process of claim 1 wherein the hydrocarbon feed is selected from the group consisting of ethane, propane, or mixtures thereof and the mixed feed is heated by indirect heat exchange with superheated steam to a temperature within the range from about 600° C. to about 700° C.

3. The process of claim 1 wherein the hydrocarbon feed is naphtha having an end point between about 150° C. and about 250° C. and the mixed feed is heated by indirect heat exchange with superheated steam to a temperature within the range from about 430° C. to about 650° C.

4. The process of claim 1 wherein the hydrocarbon feed is gas oil having an end point between about 290° C. and about 570° C. and the mixed feed is heated by indirect heat exchange with superheated steam to a temperature within the range from about 450° C. to about 570° C.

5. The process of claim 1 wherein the process for steam cracking additionally comprises a cracked gas quench boiler for raising at least a portion of the steam that is superheated in the convection section.

* * * * *